US006450773B1

(12) United States Patent
Upton

(10) Patent No.: US 6,450,773 B1
(45) Date of Patent: Sep. 17, 2002

(54) PIEZOELECTRIC VACUUM PUMP AND METHOD

(75) Inventor: Eric Lawrence Upton, Bellevue, WA (US)

(73) Assignee: Terabeam Corporation, Kirkland, WA (US)

( * ) Notice: Subject to any disclaimer, the term of this patent is extended or adjusted under 35 U.S.C. 154(b) by 0 days.

(21) Appl. No.: 09/805,654

(22) Filed: Mar. 13, 2001

(51) Int. Cl.[7] ..... F04B 17/00

(52) U.S. Cl. ..... 417/53; 417/413.2; 417/413.3; 417/478; 417/479; 417/53

(58) Field of Search ..... 417/413.2, 413.3, 417/478, 479, 53

(56) References Cited

U.S. PATENT DOCUMENTS 5,798,600 A * 8/1998 Sager et al. ..... 310/328
5,816,780 A * 10/1998 Bishop et al. ..... 417/322
6,215,221 B1 * 4/2001 Cabuz et al. ..... 251/129.01

FOREIGN PATENT DOCUMENTS

JP 401113600 A * 5/1989 ..... 417/53

* cited by examiner

*Primary Examiner*—Charles G. Freay
*Assistant Examiner*—Emmanuel Sayoc
(74) *Attorney, Agent, or Firm*—Blakely, Sokoloff, Taylor & Zafman, LLP

(57) ABSTRACT

A piezoelectric vacuum pump that includes a diaphragm comprising an upper diaphragm member and a lower diaphragm member. The diaphragm members preferably comprise thin metal sheets that are plated with a noble metal, such as gold, silver, or platinum, and are mated together so as to form a hermetic seal along the length of the diaphragm. The piezoelectric vacuum pump further includes a plurality of piezoelectric bimorph elements that are mounted to the upper surface of the upper diaphragm member. When the piezoelectric bimorph elements are electrically activated, they cause a localized portion of the upper diaphragm member to flex, thereby creating a change in volume in a portion of the diaphragm proximate to that piezoelectric bimorph element. The apparatus further includes a sequencing circuit that provides a patterned switching sequence to control electrical activation of selected piezoelectric bimorph elements such that a volume of gas is drawn into an input port, moved through the diaphragm, and exhausted out of an output port.

8 Claims, 5 Drawing Sheets

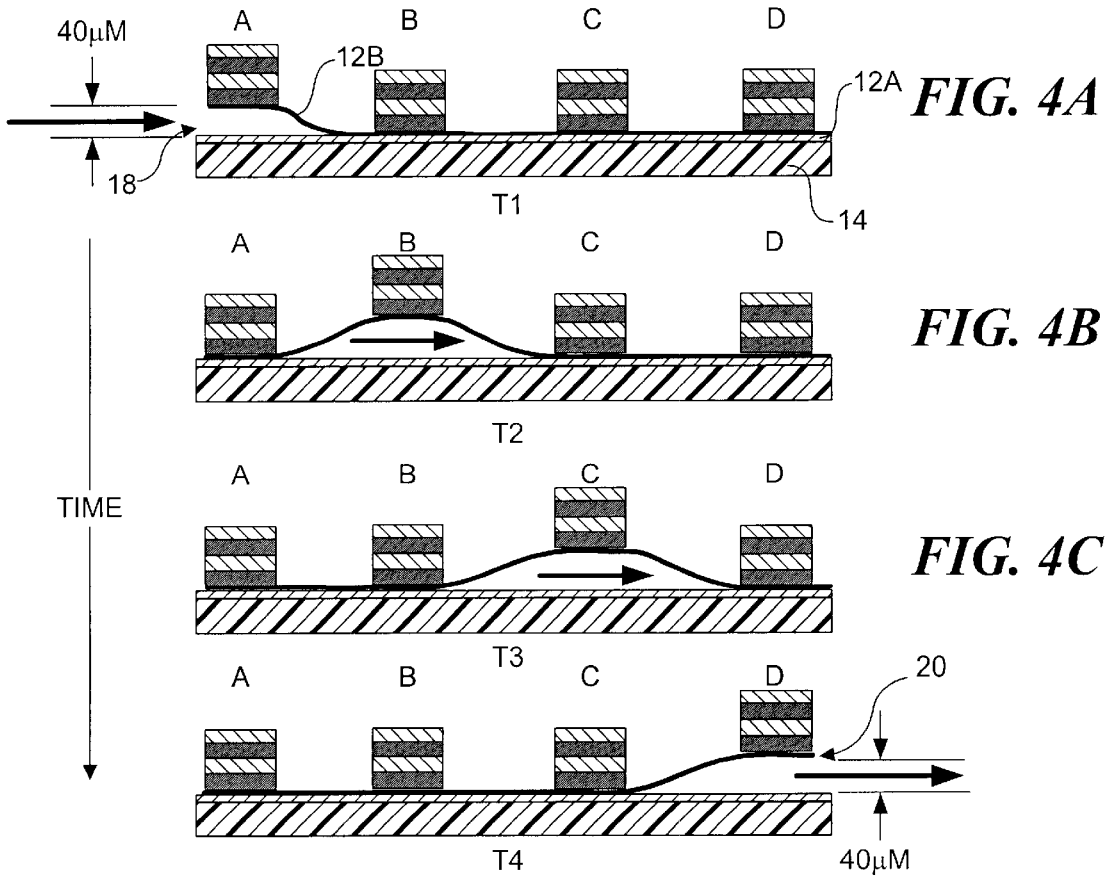
FIG. 4A
FIG. 4B
FIG. 4C
FIG. 4D
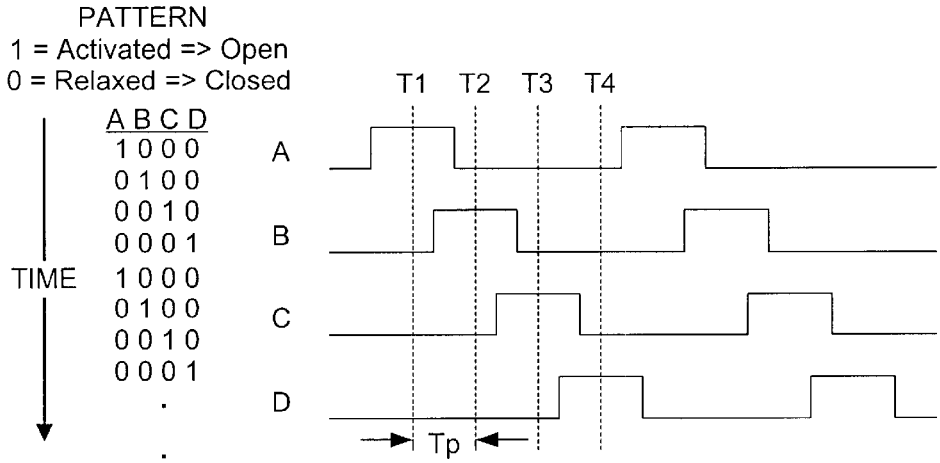
FIG. 4E

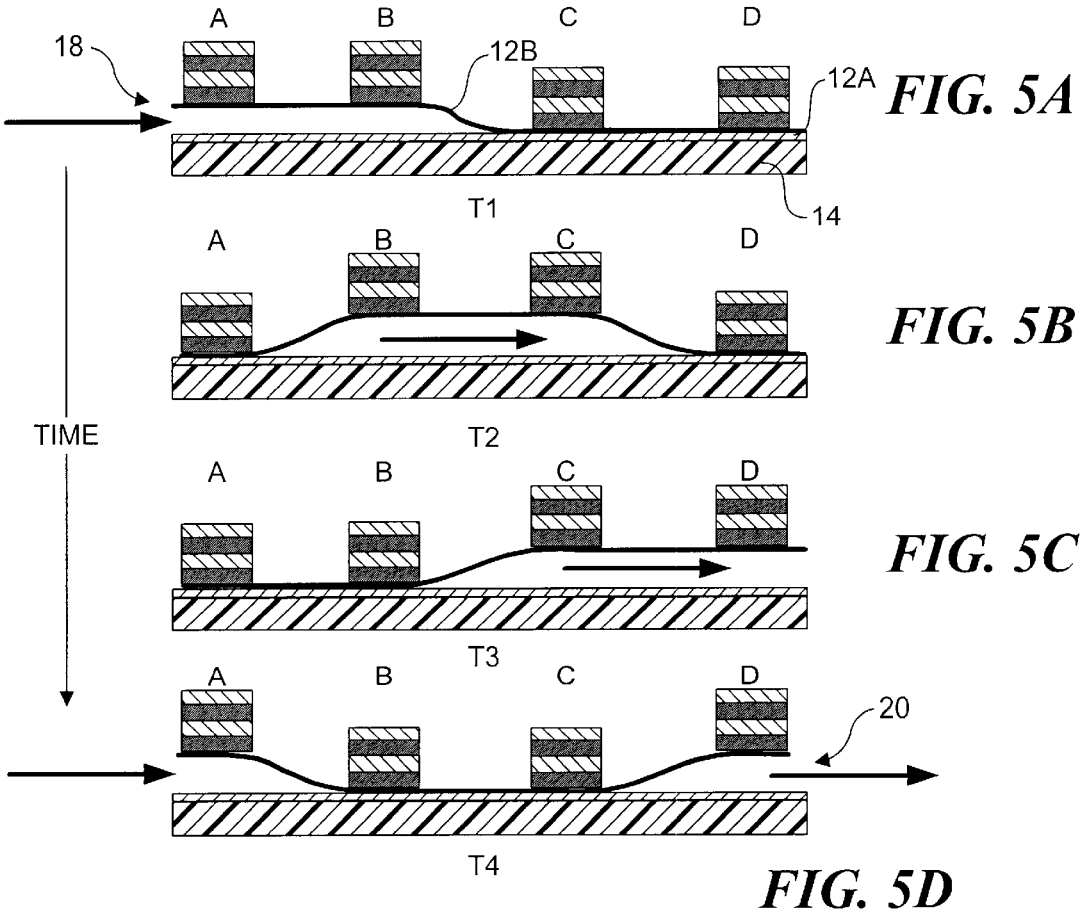
FIG. 5A
FIG. 5B
FIG. 5C
FIG. 5D
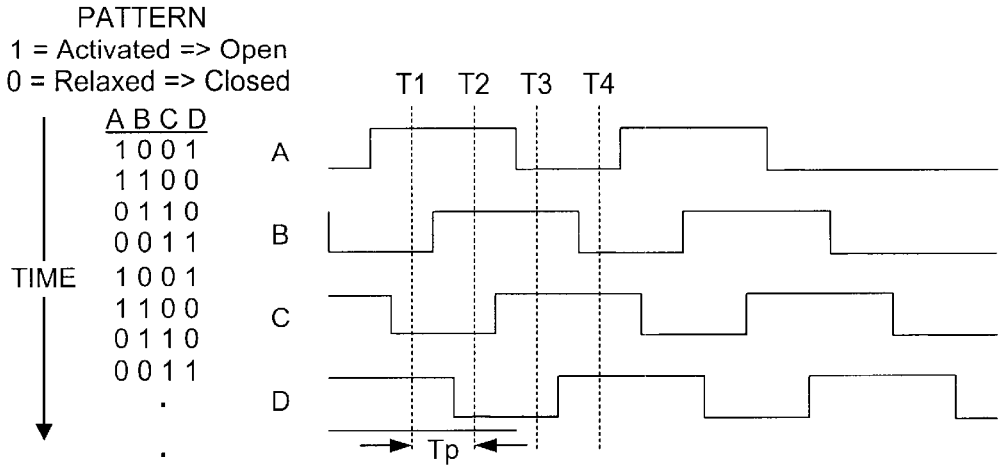
FIG. 5E

PIEZOELECTRIC VACUUM PUMP AND METHOD

BACKGROUND OF THE INVENTION

1. Field of the Invention

The present invention relates to vacuum pumps in general, and vacuum pumps operated by piezoelectric elements in particular.

2. Background Information

It is often desirable to secure various objects to other object through application of a vacuum. Typically, such a vacuum attachment of objects is accomplished by mating a surface area of the object to be secured to a corresponding surface of the other object. A vacuum is then applied to a recessed area or volume that is formed in one (or both) of the objects, creating a pressure differential that forces the objects together at the mating surfaces.

In most applications, vacuum attachment is used for only a short duration. For example, vacuum devices are often employed in pick and place machines, and for moving objects such as windshields during manufacturing operations. In general, vacuum attachment is not suitable for long-term purposes because the vacuum will decrease over time due to leakage. Oftentimes, a pliable material, such as rubber is used at the mating surfaces to form a seal, thereby enhancing the level of vacuum that may be obtained. Unfortunately, these materials allow gases to slowly pass through them, resulting in the loss of vacuum over time.

One way to combat the loss of vacuum over time is to employ a vacuum pump to replenish the level of vacuum on at least an intermittent basis. However, conventional vacuum pumps are both noisy and have limited lifetimes. Furthermore, the vibrations they cause generally make them unsuitable for high-precision applications.

Accordingly, there is a need for a vacuum apparatus that may be employed to maintain a vacuum for sustained periods of time. Ideally, such an apparatus should be extremely reliable, and produce virtually no noise or vibrations.

SUMMARY OF THE INVENTION

The present invention addresses the limitations discussed above by providing a piezoelectric vacuum pump that is extremely reliable and free of vibration. The piezoelectric vacuum pump includes a diaphragm comprising an upper diaphragm member and a lower diaphragm member. The diaphragm members preferably comprise thin metal sheets that are plated with a noble metal, such as gold, silver, or platinum, and are mated together so as to form a hermetic seal along the length of the diaphragm. The piezoelectric vacuum pump further includes a plurality of piezoelectric bimorph elements that are mounted to the upper surface of the upper diaphragm member. When the piezoelectric bimorph elements are electrically activated, they cause a localized portion of the upper diaphragm member to flex, thereby creating a change in volume in a portion of the diaphragm proximate to that piezoelectric bimorph element. The apparatus further includes a sequencing circuit that provides a patterned switching sequence to control electrical activation of selected piezoelectric bimorph elements such that a volume of gas is drawn into an input port, moved through the diaphragm, and exhausted out of an output port.

In one embodiment, the piezoelectric vacuum pump is designed so that it may be manufactured using conventional printed circuit board manufacturing techniques. This enables the vacuum pump to be manufactured at a reduced cost. Furthermore, due to the extremely low failure rate characteristics of the piezoelectric bimorph elements and solid-state control electronics, the vacuum pump is extremely reliable. In addition, since the piezoelectric bimorph elements are the only moving parts and are only slightly deflected during operation, the vacuum pump virtually noiseless and vibration free.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein:

FIGS. 4A–D illustrate a first exemplary timing sequence in which a single piezoelectric bimorph element is activated during a substantial portion of each timing period corresponding to the timing sequence;

FIG. 4E illustrates a timing diagram and logical timing pattern corresponding to the timing sequence of FIGS. 4A–D and the embodiment of FIGS. 2A–B;

FIGS. 5A–D illustrate a second exemplary timing sequence in which a pair of piezoelectric bimorph elements are activated during a substantial portion of each timing period corresponding to the timing sequence;

FIG. 5E illustrates a timing diagram and logical timing pattern corresponding to the timing sequence of FIGS. 5A–D and the embodiment of FIGS. 2A–B.

DETAILED DESCRIPTION OF THE ILLUSTRATED EMBODIMENTS

Figure 1:
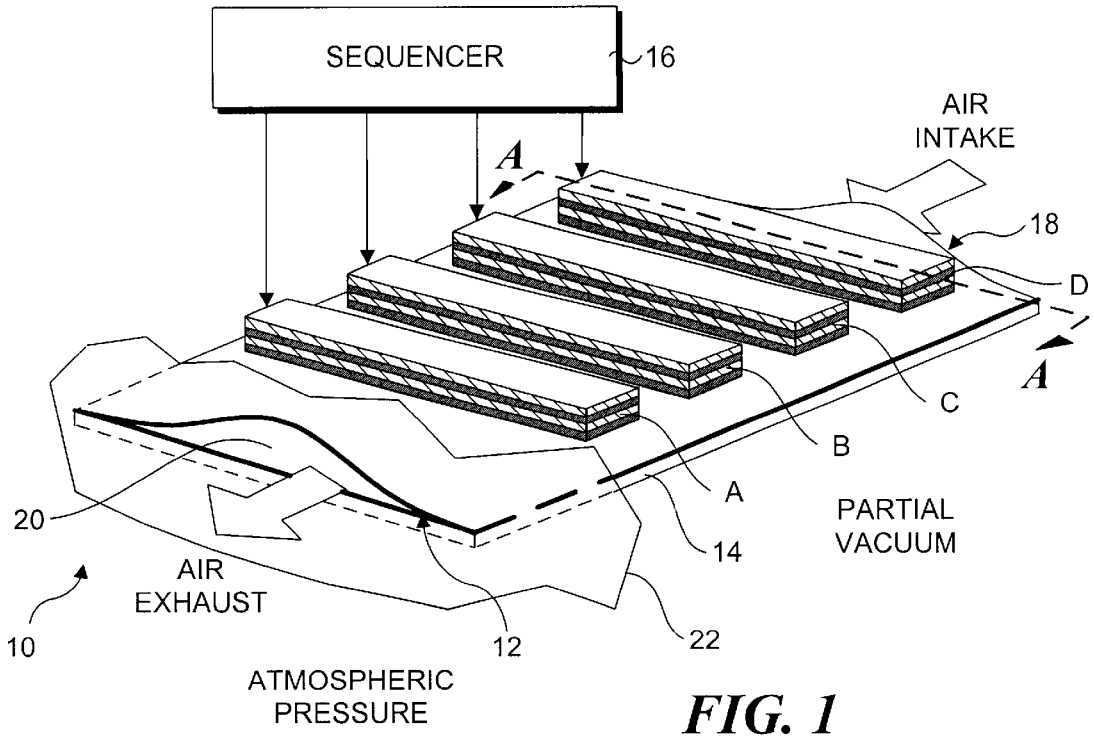
FIG. 1 is a high-level isometric view of an exemplary configuration of a piezoelectric vacuum pump in which a plurality of piezoelectric bimorph elements are selectively activated to move a gas through diaphragm, thereby creating a vacuum condition on the inlet side of the diaphragm.

A piezoelectric bimorph vacuum pump apparatus and method are described in detail herein. In the following description, numerous specific details are provided to provide a thorough understanding of embodiments of the invention. One skilled in the relevant art will recognize, however, that the invention can be practiced without one or more of the specific details, or with other methods, components, etc.

In other instances, well-known structures or operations are not shown or described in detail to avoid obscuring aspects of various embodiments of the invention.

Reference throughout this specification to "one embodiment" or "an embodiment" means that a particular feature, structure, or characteristic described in connection with the embodiment is included in at least one embodiment of the present invention. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments. It is additionally noted that the vertical scaling of the features in the drawings is exagerated to clarify the structural details of various embodiments of the invention.

A high-level view of an exemplary configuration of a piezoelectric vacuum pump 10 in accord with the present invention is shown in FIG. 1. Piezoelectric vacuum pump 10 includes a plurality of piezoelectric bimorph elements A, B, C, and D mounted on a diaphragm 12 secured to a base 14. Each of piezoelectric bimorph elements A–D is provided with an electric input that is controlled by a sequencer 16. Piezoelectric vacuum pump 10 further includes an input port 18 and an exhaust port 20. As depicted in the configuration of FIG. 1, piezoelectric vacuum pump 10 is mounted on an external wall 22 of an enclosed volume such that operation of the vacuum pump creates a partial vacuum inside of the enclosed volume.

Figure 2A:
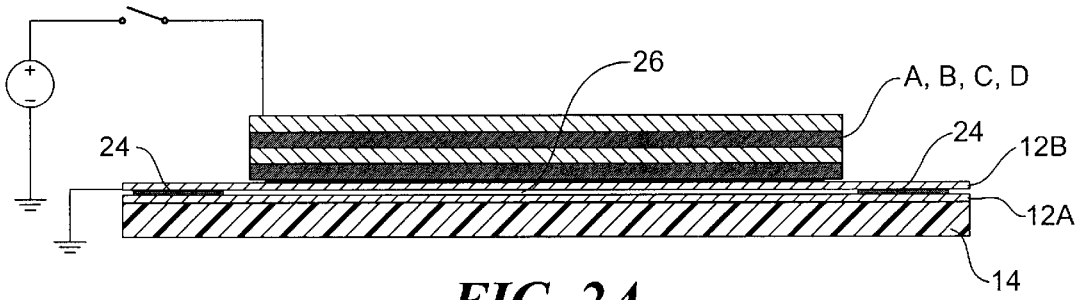
FIG. 2A is a cross-sectional view taking along line A—A of FIG. 1 illustrating the various layers of one embodiment of the piezoelectric vacuum pump of FIG. 1 when a piezoelectric bimorph element is in a relaxed state.
Figure 2B:
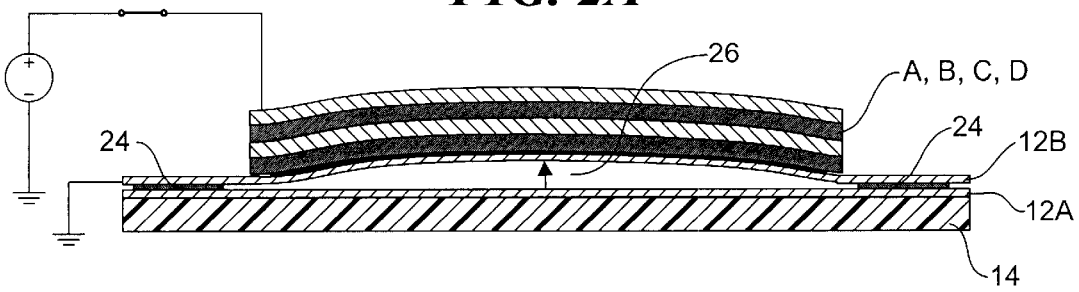
FIG. 2B depicts a configuration of the embodiment of FIG. 2A when the piezoelectric bimorph element is electrically activated.

With reference to FIGS. 2A and 2B, diaphragm 12 comprises an lower diaphragm member 12A and an upper diaphragm member 12B. In one embodiment, each of lower and upper diaphragm members comprise a thin metal sheet made of a flexible metal, such as a copper or brass shim sheet, that is plated at least on the inner surfaces with a noble metal, such as gold, silver or platinum. In an alternative embodiment, upper diaphragm member 12B comprises a resilient spring-like material, such as spring steel, plated with a noble metal.

The noble metal insures that the inner surface of diaphragm 12 does not corrode. Preferably, the noble metal should be selected such that diaphragm 12 has a minimized leakage rate; gold is an ideal candidate for this purpose, although other noble metals will work as well. In addition, upper diaphragm member 12B should be secured to lower diaphragm member 12A in a manner that creates a hermetic seal 24 between the two parts. For example, the two diaphragm members may be secured using one of many well-known metal bonding processes or using an appropriate adhesive.

In one embodiment, piezoelectric vacuum pump 10 is manufactured using conventional printed circuit board manufacturing processes. Accordingly, base 14 comprises a multi-layer fiberglass board and lower diaphragm member 12A comprises a copper layer disposited on or mounted to the board. Next, a gold or silver layer is deposited on the copper layer. Alternatively, the copper layer may be preplated. Another plated copper layer corresponding to upper diaphragm member 24 is then mounted to or deposited on the first copper layer such that a central portion 26 of upper diaphragm member 24 diaphragm 12 may be be separated from lower diaphragm member 12A. If a deposition technique is used, a mask may be employed to prevent a central portion 26 from receiving the deposited metal, and gold is first deposited, followed by a layer of copper. Piezoelectric bimorph elements A–D are then secured to the upper surface of upper diaphragm member 12A, preferably by using wave-soldering or a similar high-volume pcb manufacturing technique.

Each of piezoelectric bimorph elements A–D comprises at least one piezoelectric bimorph strip. Generally, such a bimorph strip will comprise a strip of piezoelectric material (e.g., a piezoelectric ceramic) mounted adjacent to a metallic strip. Optionally, the bimorph strip may comprise a pair of piezoelectric strips operated in an opposite mode (i.e., one strip is caused to expand while the other is caused to contract). Piezoelectric bimorph strips operate in a manner similar to a bimetallic strip in a thermostat, wherein a bending action is caused due to the dissimilar expansion of the materials under an activation condition. However, unlike thermostats, which are activated based on a change in temperature, piezoelectric bimorph strips are caused to bend by applying a voltage differential across the piezoelectric material.

It is common for piezoelectric bimorph elements to comprise a stack of piezoelectric bimorph strips, thereby producing a greater degree of bending and/or greater bending force for a given input voltage. For example, the piezoelectric bimorph elements A–D may comprise a pair of piezoelectric bimorph strips, such as that depicted in FIGS. 1, 2A and 2B, or they may comprise three or more piezoelectric bimorph strips.

In one embodiment, upper diaphragm member 12B is connected to ground, and a positive or negative voltage is applied to each of piezoelectric bimorph elements A–D in a selected pattern to activate each of element, thereby causing an increase in the volume in central portion 26, as shown in FIG. 2B. In an alternative embodiment, upper diaphragm member 12B is formed such that it has a "rest" state having a configuration similar to that depicted in FIG. 3A, and a voltage differential is applied to piezoelectric bimorph elements A–D to cause upper diaphragm member 12B to mate against lower diaphragm member 12A, as depicted in FIG. 3B.

Piezoelectric vacuum pump 10 operates in the following manner. As the piezoelectric bimorph elements are activated (or deactavated in the case of the embodiment shown in FIGS. 3A–B), a localized portion of upper diaphragm member 12B is caused to flex, thereby increasing the volume in a portion of diaphragm 12 proximate to the piezoelectric bimorph element. By activating (or deactiving) the piezoelectric bimorph elements in a selected sequence, gas can be caused to be drawn into input port 18, moved through diaphragm 12, and exhaused out of output port 20.

Two such selected sequences are respectfully shown in FIGS. 4A–F and FIGS. 5A–F. With reference to FIGS. 3A–3E, a first exemplary "ripple" sequence is illustrated, wherein a single piezoelectric bi-morph element is activated during a given timing period Tp, with a small amount of overlap. The logical timing sequence is depicted to the left of the timing diagram shown in FIG. 4E; it will be recognized by those skilled in the art that while the logical timing sequence does not show any overlap, such an overlap is depicted in the timing diagram. As illustrated in FIGS. 4A–D, as piezoelectric bimorph elements A–D are sequentially activated, a volume of gas (e.g., air) is caused to move from input port 18 through diaphragm 12 to output port 20. In one embodiment, the distance between the lower and upper diaphram members 12A and 12B is approximately 40 $\mu$M in proximity to portions of diaphragm 12 that are caused to flex by activation of one or more piezoelectric bimorph elements A–D. Another exemplary timing sequence is depicted in FIGS. 4A–F. In this timing sequence, two piezoelectric bimorph elements are concurrently activated, with some overlap with adjacent elements. This embodiment evacuates the gas at a more rapid rate than the previous embodiment. As will be appreciated by those skilled in the art, other similar timing sequences may also be implemented, as well as using a different number of piezoelectric bimorph elements. For example, three piezoelectric bimorph elements may be implemented, with a timing diagram similar to that corresponding to elements A, B, and C in timing diagrams 4E–F and 5E–F. Similarly, five or more piezoelectric bimorph elements may be used.

Figure 3A:
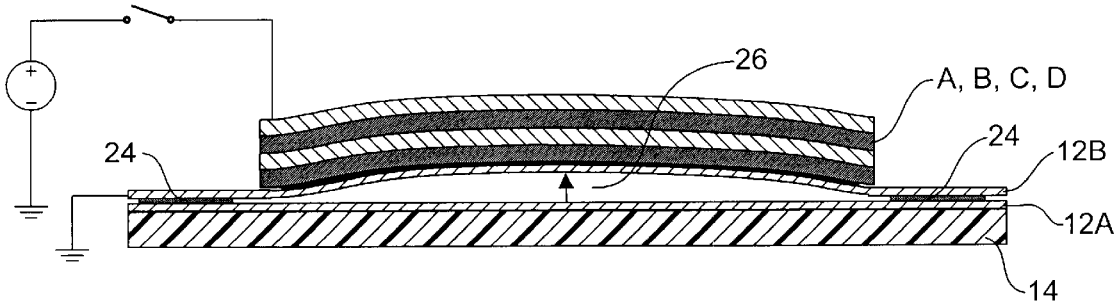
FIG. 3A is a cross-sectional view taking along line A—A of FIG. 1 illustrating the various layers of a second embodiment of the piezoelectric vacuum pump of FIG. 1 when a piezoelectric bimorph element is in a relaxed state.
Figure 3B:
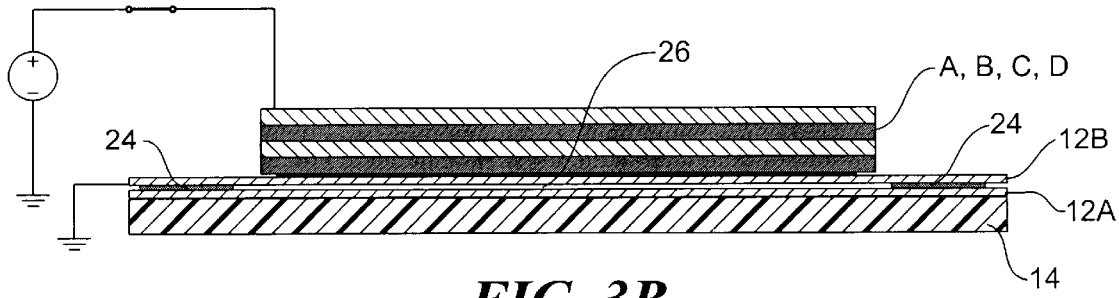
FIG. 3B depicts a configuration of the embodiment of FIG. 3A when the piezoelectric bimorph element is electrically activated.
Figure 4F:
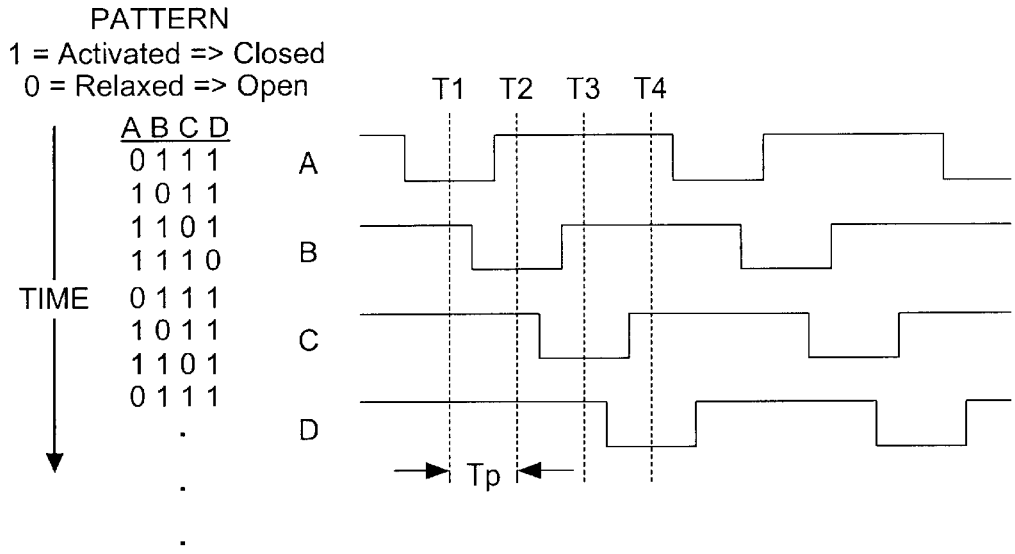
FIG. 4F illustrates a timing diagram and logical timing pattern corresponding to the timing sequence of FIGS. 4A–D and the embodiment of FIGS. 3A–B.
Figure 5F:
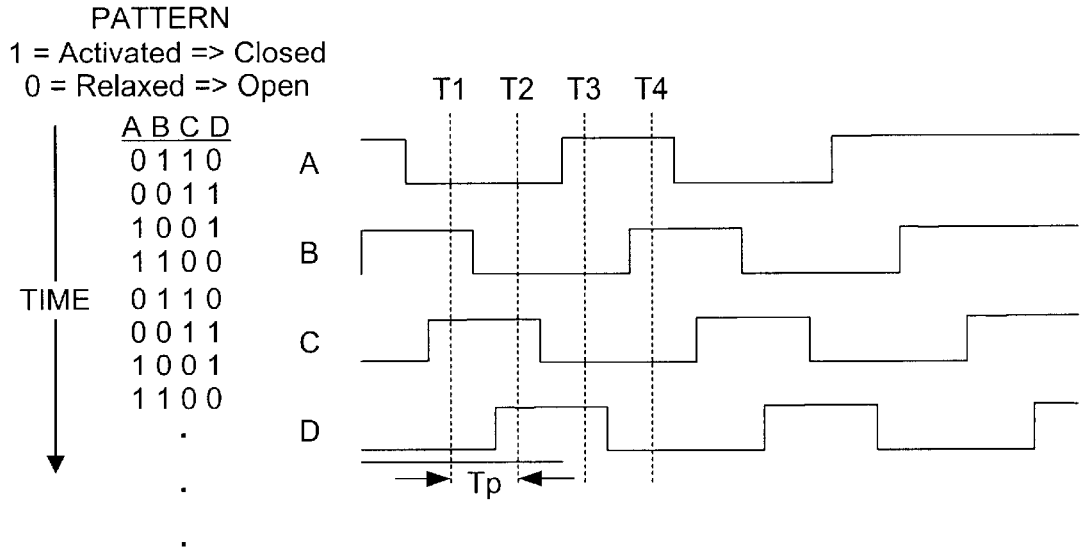
FIG. 5F illustrates a timing diagram and logical timing pattern corresponding to the timing sequence of FIGS. 5A–D and the embodiment of FIGS. 3A–B.

In the case of the embodiment shown in FIGS. 3A and 3B, activation of a piezoelectric bimorph element causes the volume in the portion of diaphragm 12 to decrease. Accordingly, FIGS. 4F and 5F depict timing diagrams and logical sequences that are inverted from those shown in FIGS. 4E and 5E, respectively.

Sequencing the electrical activation of the piezoelectric bimorph elements may be accomplished by one of many well known sequencing techniques. For example, a common timing circuit may be cascaded, or a programmable timer that provides multiple outputs may be used. Additional embodiments may be implemented with an PFGA (field programmable gate array), an ASIC (application-specific integrated circuit), or a microcontroller. In general, the output of one of the foregoing timing circuits will be used to drive a switch, such as an operational amplifier or other type of solid state switch, or a relay-type switch. The voltage differential may typically be provided through use of an appropriate power supply or battery power source. In a preferred configuration applicable for fail-safe implementations, the power supply should be combined with a battery backup such that power is supplied to the pump during power-failure conditions. Circuits for implementing such a battery backup scheme are well known in the art, and are not depicted herein for brevity.

The piezoelectric vacuum pump described above provides several desirable features. One such feature is that it is extremely reliable, with only a few moving parts that do not deteriorate over the lifetime of the device and are unlikely to fail. Another advantage is that it is extremely quiet and free of vibration. A further advantage is that it can be made using conventional printed circuit board manufacturing processes, enabling the vacuum pump to be made in high volumes at a low cost.

Although the present invention has been described in connection with a preferred form of practicing it and modifications thereto, those of ordinary skill in the art will understand that many other modifications can be made to the invention within the scope of the claims that follow. Accordingly, it is not intended that the scope of the invention in any way be limited by the above description, but instead be determined entirely by reference to the claims that follow.

What is claimed is:

1. A piezoelectric vacuum pump comprising:

a base comprising a fiberglass board a diaphragm having an upper diaphragm member comprising a thin metal sheet plated with a noble metal on at least a lower surface thereof and a lower diaphragm member comprising a layer of copper on which a layer of a noble metal is deposited and including an input port and an output port;

a plurality of piezoelectric bimorph elements, mounted to an upper surface of the upper diaphragm member, each of said piezoelectric bimorph elements causing a portion of the upper diaphragm member to flex when electrically activated, thereby creating an change in volume in a portion of the diaphragm proximate to that piezoelectric bimorph element; and a sequencing circuit, to provide a patterned switching sequence that may be used to control electrical activation of selected piezoelectric bimorph elements such that a volume of gas is drawn into the input port, moved through the diaphragm, and exhausted out of the output port.

2. The piezoelectric vacuum pump of claim 1, wherein each of the plurality of piezoelectric bimorph elements is mounted to a top surface of the upper diaphragm member using a wave soldering process.

3. The piezoelectric vacuum pump of claim 1, wherein a volume in a portion of the diaphragm proximate to a piezoelectric bimorph element is increased when that piezoelectric bimorph element is electrically activated.

4. The piezoelectric vacuum pump of claim 1, wherein the upper diaphragm member comprises a resilient material that is formed such that there is a gap between a middle portion of the upper and lower diaphragm members when no electrical energy is supplied to the piezoelectric bimorph elements, said gap being reduced upon activation of a piezoelectric bimorph element such that a volume in a portion of the diaphragm proximate to that piezoelectric bimorph is decreased.

5. The piezoelectric vacuum pump of claim 1, wherein the plurality of piezoelectric bimorph elements comprise at least three adjacently-disposed rectangular piezoelectric bimorph elements, and wherein the sequencer is configured to selectively activate the piezoelectric bimorph elements such that single piezoelectric bimorph elements are activated over a substantial portion of timing periods corresponding to a timing of the sequencer in a sequential ripple pattern, thereby causing the volume of gas to be drawn into the input port, moved through the diaphragm, and exhausted out of the output port.

6. The piezoelectric vacuum pump of claim 1, wherein the plurality of piezoelectric bimorph elements comprise at least four adjacently-disposed rectangular piezoelectric bimorph elements, and wherein the sequencer is configured to selectively activate the piezoelectric bimorph elements such that at least two bimorph elements are concurrently activated over a substantial portion of timing periods corresponding to a timing of the sequencer to produce a sequential ripple pattern; thereby causing the volume of gas to be drawn into the input port, moved through the diaphragm, and exhausted out of the output port.

7. The piezoelectric vacuum pump of claim 1, wherein the piezoelectric vacuum pump is manufactured using printed circuit board manufacturing processes.

8. The piezoelectric vacuum pump of claim 1, wherein a hermetic seal is disposed between the upper and lower diaphragm members to prevent leakage.

* * * * *